United States Patent [19]

von Rybinski et al.

[11] Patent Number: 4,714,544

[45] Date of Patent: Dec. 22, 1987

[54] PROCESS FOR DRESSING KAOLINITE BY FLOTATION

[75] Inventors: Wolfgang von Rybinski; Holger Tesmann, both of Duesseldorf; Bohuslav Dobias, Regensburg, all of Fed. Rep. of Germany

[73] Assignee: Henkel Kommanditgesellschaft auf Aktien, Duesseldorf, Fed. Rep. of Germany

[21] Appl. No.: 834,072

[22] Filed: Feb. 26, 1986

[30] Foreign Application Priority Data

Feb. 27, 1985 [DE] Fed. Rep. of Germany ..... 3506808

[51] Int. Cl.[4] ..... B03D 1/00

[52] U.S. Cl. ..... 209/167; 209/166

[58] Field of Search ..... 209/166, 167

[56] References Cited

U.S. PATENT DOCUMENTS

| | | | |
|---|---|---|---|
| 3,203,968 | 8/1965 | Sebba | 209/167 X |
| 3,979,282 | 9/1976 | Cundy | 209/166 |
| 4,501,658 | 2/1985 | Young | 209/166 X |
| 4,518,491 | 5/1985 | Bilimovia | 209/166 |

OTHER PUBLICATIONS

"Froth Flotation"; Fuerstenav, D. W.; AIME 1962; pp. 51–52.
Chem. Ab. 72, 102251m (1970).
Chem. Ab. 74, 102589 (1972).
Chem. Ab. 68, 116 041A (1968).
Chem. Ab. 71, 5014h (1969).
Chem. Ab. 79, 147 840p.
Chem. Ab. 92, 150, 570 (1980).
Handbook of Chemistry and Physics, 66th ed., 1985–86, p. F–298; published by CRC Press, Inc., Boca Raton, Fla.; edited by R. C. Weast.

*Primary Examiner*—Kenneth M. Schor
*Attorney, Agent, or Firm*—Ernest G. Szoke; Henry E. Millson, Jr.

[57] ABSTRACT

Process for the selective separation of kaolinite and feldspar by flotation in aqueous pulp, wherein flotation is carried out at the pH-value of the pulp which is naturally obtained during suspension of the mixture of minerals in water using water-soluble salts with trivalent metal ions as activators and depressors, in the presence of cationic and/or anionic surfactants as collectors, and optionally in the presence of other standard flotation aids.

18 Claims, No Drawings

PROCESS FOR DRESSING KAOLINITE BY FLOTATION

BACKGROUND OF THE INVENTION

1. Field of the Invention

This invention relates to a process for dressing kaolinite by flotation and more particularly to a process by which kaolin and feldspar can be separated in the ultrafine particle range and may both be obtained in high yields of pure mineral.

2. Discussion of Related Art

Kaolinite is a naturally occurring industrial mineral with a large and growing demand for its many and varied applications as a filler in the paper and ceramics industry, in the plastics industry and in the manufacture of paints, lacquers, rubber and cables. Kaolinite is formed from feldspar by exogenous (weathering, ground water) and endogenous (hydrothermal hot solutions, underground gases) influences at predominately acidic pH values (Ullmanns Enzyklopadie der technischen Chemie. Vol. 13, page 509 (1977)). High quality demands on the kaolinite product in terms of purity are more difficult to satisfy, the higher the proportions of as yet non-kaolinite feldspar and quartz in existing and newly opened kaolinite deposits. Kaolinite has to be selectively separated from these accompanying minerals.

The dressing of the crude kaolin which, in addition to the main mineral kaolinite, generally contains feldspar, quartz and also various ferrous and titanium minerals is mostly carried out by wet processes in which the kaolinite-containing crude ore is suspended in water. The separation process is based on separation of the various mineral components according to particle size and specific gravity. Because the minerals quartz and feldspar, which accompany the kaolinite, are generally coarser ("anti-parallel particle distribution"), it is possible in this way to satisfactorily separate the coarser quartz and feldspar from kaolinite up to particle sizes of 2 μm (cf. M. Clement and H. M. Troendle; Erzmetall 22, No. 3, 131 (1969)).

Because feldspar is also a raw material widely used in the ceramic industry, every attempt is made when separating kaolinite and feldspar from crude kaolin to obtain not only pure kaolinite, but also a feldspar product which satisfies the stringent demands for industrial utilization in the glass and ceramics industry. It is known that mechanical separation processes in aqueous pulp can be used for this purpose. However, the effectiveness of separation processes such as these reaches a limit when the particle sizes of kaolinite and feldspar in the ultra-fine particle range lie very close to one another, because the specific gravity of the two minerals (approx. 2.58 g/cm$^3$) is substantially the same. In such a case, the demand for high purity of both end products, kaolinite and feldspar, is accompanied by an economically significant loss in the non-separable particle classes (ultra-fine particle range). The separation of kaolinite and feldspar in aqueous pulp is described in detail in B. M. Coope, Industrial Minerals, 1979, 33 to 49 and H. H. Murray, Int. J. of Mineral Processing 7, 263 (1980).

Flotation processes are used in the cleaning of minerals to remove heavy metal oxides, for example oxides of iron and titanium, from kaolinite and hence to improve the whiteness of the product. Separate processes for separating kaolinite from quartz on the one hand and feldspar from quartz on the other hand by flotation of the minerals in the presence of an amine as collector are also known from H. M. Troendle, M. Clement and B. Becher, Interceram 19, 185 and 268 (1970) corresponding to Chemical Abstracts 74, 102589 u (1972). Hydrochlorides and hydroacetates of long-chain aliphatic amines are used as collectors in acidic pulps.

Flotation tests with kaolin-quartz and feldspar-quartz mixtures are also described in H. M. Troendle, M. Clement and B. Brehler, Keramische Zeitschrift 21, 423 and 489 (1969) corresponding to Chemical Abstracts 72, 102251 m (1970). Aqueous pulps containing hydrofluoric acid and hydrochloric acid are used with long-chain aliphatic amines as collectors for separating the particular kaolinite and feldspar minerals from quartz. In the process where kaolinite is separated from quartz, it was also found that a significant reduction in the recovery of kaolinite at alkaline pH-values of the aqueous pulp is attributable to the fact that the non-dissociated amine molecules formed in accordance with equation (1) below are no longer adsorbed onto the negatively charged kaolin surface and hence prevent the kaolinite content of the pulp from being extracted with the ammonium salt:

$$R{-}NH_3^+ + OH^- \rightleftharpoons R{-}NH_2 + H_2O \qquad (I)$$

The ultrafine range of kaolinite and feldspar particles is of particular interest for the dressing of aqueous pulps containing both minerals. Hitherto, separation of the two minerals in this particle range has not been possible on an industrial scale. However, it is this range which is particularly important in practice insofar as mineral mixtures having a particle distribution of 90% smaller than 30 μm for kaolinite and 10% smaller than 30 μm for feldspar accumulate during the washing out of the kaolinite-and feldspar-containing deposits. Kaolins suitable for use in the ceramics field have an ultra-fine particle fraction (smaller than 2 μm) of 50% or more. In this particle size range, selective flotation in aqueous pulp presents considerable problems. Direct flotation for separating kaolinite and feldspar in this particle range has never been described before.

It is known that polyvalent cations are adsorbed on the surfaces of the mineral particles suspended in the aqueous pulp and are capable of influencing the floatability of these mineral particles within wide limits (B. Dobias, 6th International Congress on Surface-Active Agents, Zurich 1972, page 563 (1973)). In addition, polyvalent cations are capable of reacting with the collector surfactant to form complex compounds or sparingly soluble deposits and thus removing the surfactant from the desired adsorption process on the surface of the mineral particles. Experience has shown that this reduces the flotation yield unless increased quantities of the collector surfactant are used.

Depending on the composition of the system to be dressed by flotation, the same polyvalent cation can have both an activating effect and a deactivating effect for the chosen collector (surfactant) in the flotation of mineral particles. The question of which of the two properties dominates can only be empirically determined. In general, the flotation process itself is disturbed rather than promoted by these effects, of which the action mechanisms are not yet completely known in detail. Accordingly, suppressing the undesirable effect of polyvalent cations in the floation process is a special problem in the dressing of the particular minerals.

The activating or deactivating ("depressing") effect of polyvalent cations on silicate-containing minerals is known in part from the literature. Thus, it is reported in Chemical Abstracts 68, 116 041A (1968) that aluminium, iron and calcium ions have an activating effect in the flotation of quartz, feldspar and sillimanite. If the concentration of iron(III) and aluminium(III) salts is increased to values above 300 mg per liter, there is a distinct reduction in the activating effect at acidic and alkaline pH values in the flotation of silicates.

The use of cationic collectors in acidic media in the separation of quartz-feldspar sands by floation in the presence of copper(II), calcium, iron(III) and aluminium(III) ions is described in Chemical Abstracts 71, 5014h (1969). In strong sulfuric acid or hydrochloric acid media, the cations mentioned have an activating effect on feldspar and a depressing effect on quartz.

The separation of feldspar from accompanying materials by flotation in the presence of aliphatic amines or petroleum sulfonates in strong sulfuric acid solutions is described in Chemical Abstracts 79, 147 840p (1973). $SiO_2$, $Al_2O_3$ and $Fe_2O_3$ are added as activitors to the aqueous pulps; the recovery of feldspar from the pulps increasing with increasing concentrations of collectors.

In Neue Bergbautechnik 9, 349 (1979), corresponding to Chemical Abstracts 92, 150,570 (1980), it is reported that, in the aqueous flotation of feldspar-quartz mixtures in the presence of long-chain aliphatic amines, aluminium trichloride has an activating effect on feldspar and a depressing effect on quartz in the pulp. However, the problem of separating kaolinite and feldspar in aqueous pulps is not discussed in any of the literature references mentioned above.

DESCRIPTION OF THE INVENTION

It has now been found that, to separate kaolinite and feldspar by flotation, it is not necessary to adjust the aqueous pulp to highly acidic pH-values with hydrohalic acids or sulfuric acid. On the contrary, kaolinite and feldspar may be selectively separated even at the natural pH value of from 5 to 8 which is spontaneously adjusted during suspension of the minerals in water. In addition, it has been found that, in the natural pH-value range, the addition of trivalent metal ions, for example $Al^{3+}$ or $Fe^{3+}$, in the form of corresponding salts distinctly improves selectivity in the separation by flotation of kaolinite and feldspar in the ultrafine particle range. It has also been found that, where the aqueous pulp is adjusted to natural pH-values and trivalent metal ions are used, flotation with anionic surfactants as collectors has advantages over cationic flotation.

Accordingly, the present invention relates to a process for the selective separation of kaolinite and feldspar by flotation in aqueous pulp, wherein flotation is carried out at the pH-value of the pulp which is naturally obtained during suspension of the mineral mixture in water, using water-soluble salts of trivalent metal ions as activators and depressors, in the presence of cationic or anionic surfactants as collectors, and optionally in the presence of other standard flotation aids.

Other than in the operating examples, or where otherwise indicated, all numbers expressing quantities of ingredients or reaction conditions used herein are to be understood as modified in all instances by the term "about".

The pH value at which the process of invention is carried out is generally in the range of from 5 to 8. This pH-value is spontaneously obtained when the mineral mixtures degraded in solid form are suspended in tapwater or in fully deionized water or when the mixture of minerals is washed out from the rock material and brought to the surface by high-pressure jets of water. The addition of large quantities of activating acids, for example hydrohalic acid or sulfuric acid, to adjust to a highly acidic pH-value, such as has hitherto had to be adjusted in flotation processes of the present type, has now been found to be no longer necessary for achieving effective and selective separation of kaolinite and feldspar.

Salts of trivalent metal ions are added to the aqueous pulps as activators or depressors in accordance with the invention. Salts or polysalts of aluminium and/or iron(III) salts are used for this purpose. In practice, it is of advantage to use the sulfuric acid salts of trivalent metals. The concentration of the salts is in the range of from 50 to 2000 g/t and preferably in the range of from 100 to 1000 g/t, based on the anhydrous metal salt.

According to the invention, it is particularly preferred to use aluminium salts, for example aluminium sulfate, because it has been found that, in aqueous pulps, the Al(III) ion has an activating effect on kaolinite and a deactivating, i.e. depressing, effect on feldspar at pH values in the range of from 5 to 8. Through the addition of aluminium salts to the aqueous pulp, flotation gives concentrates having a higher concentration of kaolinite. At the same time, the recovery of kaolinite is increased, so that feldspar in relatively high purity also accumulates as flotation residue.

Cationic or anionic surfactants can be used as collectors in the process of the invention. The cationic surfactants used can be monoalkyltrimethylammonium compounds, dialkyldimethylammonium compounds, alkylarylammonium compounds, alkylamines, hydroxylamines and/or hydroxyalkylaminopolyglycolethers, with the above compounds preferably containing $C_{12}$–$C_{18}$ alkyl groups. Preferred aryl groups are phenyl and/or benzyl groups.

Importantly, however, the use of aluminium ions in the separation of kaolinite and feldspar by flotation enables the process to be carried out using anionic surfactants as collectors. Surprisingly, flotation with anionic collectors has proved to be particularly advantageous over flotation with cationic surfactants insofar as separating off fractions of heavy minerals in the ore from the kaolinite before flotation, which leads to greater whiteness of the kaolinite concentrate and to an improvement in the quality of the feldspar residue. In addition, the subsequent dressing of the kaolinite is facilitated since anionic surfactants can be desorbed more easily from the surface of the kaolinite particles than cationic surfactants. Another important factor is that their environmental behaviour alone makes anionic surfactants preferable to cationic surfactants.

The anionic surfactants used are preferably fatty acids, alkylsulfates, alkylether sulfates, alkylbenzene sulfonates, petroleum sulfonates, ester sulfonates, alkylsulfosuccinates, alkylsulfosuccinamides, alkylphosphates and/or alkylether phosphates. It is particularly preferred to use alkylbenzene sulfonates, petroleum sulfonates, fatty alcohol sulfates, ester sulfonates and/or alkylsulfosuccinates in which the alkyl groups have the chain lengths given above.

According to the present invention, it is also possible to use mixtures of cationic and anionic surfactants with nonionic additives, for example fatty alcohol, alkylpolyglycolethers and/or alkylphenolpolyglycolethers.

The concentration of surfactants used as collectors in accordance with the invention is from 50 to 2000 g/t and preferably from 100 to 1000 g/t.

According to the invention, other standard flotation aids may be added to the aqueous pulp for the separation of kaolinite and feldspar by flotation. Examples of such flotation aids are, for example, foaming agents on the one hand and defoaming agents on the other hand, although—in contrast to state-of-the-art processes—they are not absolutely essential.

Where the constituents proposed in accordance with the invention are used, kaolinite in the mineral mixture of kaolinite and feldspar is floated while feldspar accumulates as flotation residue in surprisingly high purity compared with state-of-the-art processes. Depending on the quality requirements which the products have to satisfy, the particular flotation steps are optionally repeated, with selective separation of the two components being achieved in particular in the ultra-fine particle range. According to the invention, another post-purification step is sufficient for obtaining concentrates having a kaolinite content of from 93 to 97%.

The kaolinite obtained by flotation is worked up in the following process steps in which the surfactants adsorbed on the surface are desorbed. In the case of the anionic surfactants preferably used herein, the surfactant molecule is bound to the negatively charged surface of the kaolinite particles through the ion bridges consisting of trivalent metal ions, so that the anionic surfactants can be desorbed more easily from the surface of the kaolinite than cationic surfactant molecules.

Another advantage of the process of the invention lies in the fact that the flotation of kaolinite by anionic or cationic surfactants in the presence of trivalent metal ions, preferably aluminium(III) ions, is largely unaffected by the water hardness or by the content of inert electrolytes in the pulp. Although divalent ions, for example calcium or magnesium ions, also improve selectivity in the floation of the kaolinite/feldspar mineral mixture, this effect only occurs at very high ion concentrations which would make the addition of these ions to the flotation pulp uneconomical.

The selective separation of kaolinite and feldspar by flotation in accordance with the invention has proved to be particularly effective in the very fine particle size range of the minerals involved, i.e. especially when conventional separation processes present serious problems. Particle sizes in the 2 to 30 μm range are preferred for the application of the process of the invention.

Normally, the quartz content of the crude products used for the flotative separation of kaolinite and feldspar is minimal by virtue of a preceding separation process, so that quartz does not have to be separated off. However, where the crude product has a high quartz content, it is also possible after the flotation of kaolinite to float feldspar in order to separate quartz by reactivation with aluminium ions and the addition of a collector. This is done by methods known from the prior art.

The invention is illustrated by the following Examples, which are given for that purpose only and not for purposes of limitation.

The flotation tests were carried out in a 1 liter and 2 liter Humboldt-Wedag laboratory flotation cell using a kaolinite/feldspar/quartz fraction having a particle size of 90% <20 μm. This fraction was taken from the intermediate stage of a standard kaolinite dressing plant.

The selectivity of flotation, i.e. the content of kaolinite and feldspar in the concentrate and in the flotation residue, respectively, were determined in known manner from the ignition loss (DIN 51 081 for testing ceramic raw materials and working materials by change in weight on ignition (July 1979)).

EXAMPLES 1 to 4

The mixture of minerals was pretreated for 5 minutes in the flotation cell, activating additives (sulfuric acid and/or aluminium sulfate) being added in Examples 2 to 4. An aqueous solution of a cationic collector (Araphen(TM) G2D) was then added. Flotation was carried out in the presence of a standard commercial foaming agent (Araphen(TM) G2D15).

The results are set forth in Table 1 below.

Table 1: Recovery and selectivity in the flotation of kaolinite/feldspar using a cationic collector (Araphen(TM) G2D)

TABLE 1

| Example No. | Collector (g/t) | Additives substance | Additives concentration (g/t) | Concentrate kaolinite content (%) | Concentrate recovery (%) | Flotation residue kaolinite content (%) |
|---|---|---|---|---|---|---|
| 1 | 160 | — | — | 73.4 | 87 | 10.5 |
| 2 | 260 | $H_2SO_4$ | 392 | 69.6 | 97 | 3.7 |
| 3 | 360 | $Al_2(SO_4)_3$ | 548 | 82.5 | 97 | 3.3 |
| 4 | 320 | $Al_2(SO_4)_3$ + $H_2SO_4$ | 274 392 | 82.2 | 98 | 2.2 |

Result:

Whereas in Example 1 (no activating additives) flotation has a distinctly poor separating effect both in regard to the recovery of kaolinite in the concentrate and also in regard to the kaolinite content of the flotation residue, selectivity was improved by the addition of sulfuric acid (Example 2). The addition of aluminium sulfate considerably improved the selectivity of the flotation process, so that concentrates having a high kaolinite content could be obtained by a single post-purification step.

EXAMPLES 5 to 7

Instead of the cationic collector of Examples 1 to 4, cetylpyridinium chloride was used as the cationic collector. The results are shown in Table 2 below.

Table 2: Recovery and selectivity in the flotation of kaolinite/feldspar using a cationic collector (cetylpyridinium chloride)

TABLE 2

| Example No. | Collector (g/t) | Additives substance | Additives concentration (g/t) | Concentrate kaolinite content (%) | Concentrate recovery (%) | Flotation residue kaolinite content (%) |
|---|---|---|---|---|---|---|
| 5 | 480 | $H_2SO_4$ | 392 | 58.7 | 98 | 2.9 |
| 6 | 440 | $Al_2(SO_4)_3$ | 548 | 75.8 | 98 | 2.5 |
| 7 | 480 | $Al_2(SO_4)_3$ | 823 | 86.1 | 97 | 2.9 |

Result:

Where cetylpyridinium chloride was used as the cationic collector, a distinct increase was again obtained in the selectivity of separation, while the addition of aluminium sulfate produced an increase in the percentage recovery.

EXAMPLES 8 to 11

In contrast to Examples 1 to 7, flotation was carried out using an anionic collector (sodium alkylbenzene sulfonate) in the absence (Example 8) and in the presence (Examples 9 to 11) of activating additives. The results are shown in Table 3 below.

Table 3: Recovery and selectivity in the flotation of kaolinite/feldspar using an anionic collector (sodium alkylbenzene sulfonate)

TABLE 3

| Example No. | Collector (g/t) | Additives substance | Additives concentration (g/t) | Concentrate kaolinite content (%) | Concentrate recovery (%) | Flotation residue kaolinite content (%) |
|---|---|---|---|---|---|---|
| 8 | 800 | — | — | 76.0 | 71 | 24.1 |
| 9 | 680 | $H_2SO_4$ | 392 | 72.9 | 92 | 7.5 |
| 10 | 448* | $AlCl_3$ | 319 | 82.8 | 96 | 3.9 |
| 11 | 680* | $Al_2(SO_4)_3$ + $H_2SO_4$ | 273 392 | 87.0 | 96 | 3.4 |

*Addition of 140 g/t of a defoaming agent for foam regulation.

Result:

Whereas the use of an anionic collector in the absence of activating additives produced relatively poor results in regard to the recovery of kaolinite and the residual content of kaolinite in the flotation residue, the addition of Al(III) ions to the flotation solution resulted in selective separation of kaolinite and feldspar, both the recovery of kaolinite and also the kaolinite content of the flotation residue being distinctly more favorable than where sulfuric acid was used for activation.

What is claimed is:

1. A process for the selective separation of kaolinite from feldspar by flotation in aqueous pulp comprising:

(a) suspending an ultrafine particle size mineral mixture comprising feldspar and kaolinite in water to form an aqueous pulp at a pH of from about 5 to 8;

(b) treating the aqueous pulp with a water-soluble salt of $Al^{3+}$ or $Fe^{3+}$ and a collector comprising an anionic surfactant, said collector and water-soluble salt being present in sufficient concentration to provide a kaolin float and a feldspar sink in step (c)

(c) subjecting the treated pulp to a flotation treatment to float kaolinite; and (d) recovering kaolinite from the resulting float and feldspar from the resulting flotation residue.

2. A process in accordance with claim 1 wherein the process is carried out in the presence of one or more flotation aids.

3. The process of claim 1, wherein the particle distribution in the kaolinite fraction of the mineral mixture is 90% smaller than 30 μm and the particle distribution in the feldspar fraction of the mineral mixture is 10% smaller than 30 μm.

4. A process in accordance with claim 1 wherein the water-soluble salt in step (b) is an aluminum salt.

5. A process in accordance with claim 1 wherein aluminum sulfate is the water-soluble salt in step (b).

6. A process in accordance with claim 1 wherein in step (b) the concentration of the water-soluble salt in the aqueous pulp is in the range of from about 50 to about 2000 g/t, based on the weight of the salt in anhydrous form.

7. A process in accordance with claim 6 wherein said-concentration of the water-soluble salt is in the range of from about 100 to about 1000 g/t.

8. The process of claim 1, wherein the particle distribution in the kaolinite fraction of the mineral mixture is at least 50% smaller than 2 μm.

9. A process in accordance with claim 1 wherein the concentration of the surfactant in the aqueous pulp is in the range of from about 50 to about 2000 g/t.

10. A process in accordance with claim 7 wherein the concentration of the surfactant is in the range of from about 50 to about 2000 g/t.

11. A process in accordance with claim 9 wherein said concentration of the surfactant is in the range of from about 100 to about 1000 g/t.

12. A process in accordance with claim 10 wherein said concentration of the surfactant is in the range of from about 100 to about 1000 g/t.

13. A process in accordance with claim 1 wherein the anionic surfactant is one or more of an alkylbenzene sulfonate, a petroleum sulfonate, a fatty alcohol sulfate, an ester sulfonate and an alkylsulfosuccinate, in which the alkyl groups thereof contain from 12 to 18 carbon atoms.

14. A process in accordance with claim 1 wherein the particle size of the mixture of minerals is in the range of from about 2 to about 30 μm.

15. The process of claim 1, wherein the mineral mixture further includes quartz.

16. The process of claim 15, wherein the mineral mixture has a particle distribution of 90% less than 20 μm.

17. The process of claim 1, wherein the anionic surfactant is a fatty acid, alkyl sulfate, alkylether sulfate, alkylbenzenesulfonate, petroleum sulfonate, ester sulfonate, alkylsulfosuccinate, alkylsulfosuccinamide, alkylphosphate, or alkylether phosphate,

18. The process of claim 17, wherein alkyl is $C_{12}$–$C_{18}$-alkyl.

* * * * *